US007533739B2

(12) United States Patent
Cooley et al.

(10) Patent No.: US 7,533,739 B2
(45) Date of Patent: May 19, 2009

(54) CUTTING ELEMENT APPARATUSES AND DRILL BITS SO EQUIPPED

(75) Inventors: Craig H. Cooley, Saratoga Springs, UT (US); Timothy N. Sexton, Santaquin, UT (US); David P. Miess, Highland, UT (US)

(73) Assignee: US Synthetic Corporation, Orem, UT (US)

( * ) Notice: Subject to any disclaimer, the term of this patent is extended or adjusted under 35 U.S.C. 154(b) by 176 days.

(21) Appl. No.: 11/148,806

(22) Filed: Jun. 9, 2005

(65) Prior Publication Data

US 2006/0278441 A1 Dec. 14, 2006

(51) Int. Cl.
*E21B 10/43* (2006.01)

(52) U.S. Cl. ..... 175/432; 175/413; 175/412; 175/434; 299/102; 76/108.4

(58) Field of Classification Search ..... 175/374, 175/432, 427, 413, 412, 434; 76/108.2, 108.4; 299/102, 103, 108
See application file for complete search history.

(56) References Cited

U.S. PATENT DOCUMENTS

| | | | |
|---|---|---|---|
| 2,506,341 | A | 5/1950 | Bullock |
| 2,631,360 | A | 3/1953 | Sanford et al. |
| 2,710,180 | A | 6/1955 | Graham |
| 2,917,819 | A | 12/1959 | Britton et al. |
| 3,136,615 | A | 6/1964 | Bovenkerk et al. |
| 3,141,746 | A | 7/1964 | De Lai |
| 3,271,080 | A | 9/1966 | Gowanlock |
| 3,749,190 | A | 7/1973 | Shipman |
| 4,014,395 | A | 3/1977 | Pearson |
| 4,047,583 | A | 9/1977 | Dyer |
| 4,057,884 | A | 11/1977 | Suzuki |
| 4,199,035 | A | 4/1980 | Thompson |
| 4,200,159 | A | 4/1980 | Peschel et al. |
| 4,337,980 | A | 7/1982 | Krekeler |
| 4,453,605 | A | 6/1984 | Short, Jr. |
| 4,466,498 | A | 8/1984 | Bardwell |
| 4,511,006 | A | 4/1985 | Grainger |
| 4,538,690 | A | 9/1985 | Short, Jr. |
| 4,553,615 | A | 11/1985 | Grainger |
| 4,654,947 | A | 4/1987 | Davis |
| 4,694,918 | A | 9/1987 | Hall |

(Continued)

OTHER PUBLICATIONS

Oil and Gas Well Drilling and Servicing eTool (ww.osha.gov) 2001.*

*Primary Examiner*—David J. Bagnell
*Assistant Examiner*—Brad Harcourt
(74) *Attorney, Agent, or Firm*—Holland & Hart

(57) ABSTRACT

A cutting element assembly for use on a rotary drill bit for forming a borehole in a subterranean formation. A cutting element includes a substrate having a base member affixed to a back surface of the substrate is disclosed, wherein the base member includes a recess configured to secure the base member to a rotary drill bit. An inner member may be positioned within the recess of the base member. Also, a structural element may be coupled to the inner member or to the base member. A rotary drill bit may include a cutting element assembly. In addition, a method of securing a cutting element to a rotary drill bit may include providing a base member affixed to a cutting element and positioning the base member within a recess of the rotary drill bit.

60 Claims, 12 Drawing Sheets

U.S. PATENT DOCUMENTS 4,782,903 A 11/1988 Strange
4,802,539 A * 2/1989 Hall et al. ..... 175/371
4,877,096 A 10/1989 Tibbitts
5,007,493 A 4/1991 Coolidge et al.
5,007,685 A 4/1991 Beach et al.
5,056,382 A 10/1991 Clench
5,279,375 A 1/1994 Tibbitts et al.
5,332,051 A 7/1994 Knowlton
5,351,772 A 10/1994 Smith
5,469,927 A 11/1995 Griffin
5,558,170 A 9/1996 Thigpen et al.
5,678,645 A 10/1997 Tibbitts et al.
5,810,103 A 9/1998 Torbet
5,906,245 A 5/1999 Tibbitts et al.
5,975,811 A * 11/1999 Briese ..... 407/40
6,283,234 B1 9/2001 Torbet
6,302,224 B1 10/2001 Sherwood, Jr.
6,408,959 B2 * 6/2002 Bertagnolli et al. ..... 175/432
2004/0026132 A1 * 2/2004 Hall et al. ..... 175/427
2005/0072601 A1 * 4/2005 Griffo et al. ..... 175/374
2005/0103533 A1 * 5/2005 Sherwood et al. ..... 175/432

* cited by examiner

CUTTING ELEMENT APPARATUSES AND DRILL BITS SO EQUIPPED

BACKGROUND OF THE INVENTION

1. Field of the Invention

The present invention relates generally to rotary drill bits for drilling subterranean formations, and more specifically to retention of cutting element apparatuses for use with rotary drill bits for drilling subterranean formations.

2. State of the Art

Rotary drill bits employing polycrystalline diamond compact ("PDC") cutters have been employed for drilling subterranean formations for a relatively long time. PDC cutters comprised of a diamond table formed under ultra high temperature, ultra high pressure conditions onto a substrate, typically of cemented tungsten carbide (WC), were introduced about twenty five years ago. As known in the art, drill bit bodies may comprise a so-called tungsten carbide matrix including tungsten carbide particles distributed within a binder material or may comprise steel. Tungsten carbide matrix drill bit bodies are typically fabricated by preparing a mold that embodies the inverse of the desired generally radially extending blades, cutting element sockets or pockets, junk slots, internal watercourses and passages for delivery of drilling fluid to the bit face, ridges, lands, and other external topographic features of the drill bit. Then, particulate tungsten carbide is placed into the mold and a binder material, such as a metal including copper and tin, is melted into the tungsten carbide particulate and solidified to form the drill bit body. Steel drill bit bodies are typically fabricated by machining a piece of steel to form generally radially extending blades, cutting element sockets or pockets, junk slots, internal watercourses and passages for delivery of drilling fluid to the bit face, ridges, lands, and other external topographic features of the drill bit. In both matrix-type and steel bodied drill bits, a threaded pin connection may be formed for securing the drill bit body to the drive shaft of a downhole motor or directly to drill collars at the distal end of a drill string rotated at the surface by a rotary table or top drive.

Conventional cutting element retention systems or structures that are currently employed generally comprise the following two styles: (1) tungsten carbide studs comprising a cylindrical tungsten carbide cylinder having a face oriented at an angle (back rake angle) with respect to the longitudinal axis of the cylinder, the face carrying a superabrasive cutting structure thereon, wherein the cylinder is press-fit into a recess that is generally oriented perpendicularly to the blades extending from the bit body on the bit face; and (2) brazed attachment of a generally cylindrical cutting element into a recess formed on the bit face, typically on a blade extending from the bit face. Accordingly, the first cutting element retention style is designed for a stud type cutting element, while the second cutting element retention style is designed for generally cylindrical cutting elements, such as PDC cutters. In either system, the goals are to provide sufficient cutting element attachment and retention as well as mechanical strength sufficient to withstand the forces experienced during the drilling operation. Of the two different types of cutting element retention configurations utilized in the manufacture of rotary drill bits, cylindrical cutting elements are generally more common. Stud-type cutting elements, on the other hand, are relatively uncommon and may require a brazing or infiltration cycle to affix the PDC or TSPs to the stud. Examples of other conventional cutting element attachment configurations include, inter alia, U.S. Pat. No. 6,283,234 to Torbet, U.S. Pat. No. 5,906,245 to Tibbitts, U.S. Pat. No. 5,558,170 to Thigpen et al., U.S. Pat. No. 4,782,903 to Strange, and U.S. Pat. No. 4,453,605 to Short.

Therefore, it would be advantageous to provide a cutting element retention configuration for use in rotary drill bits that ameliorates the disadvantages of conventional cutting element retention configurations. Further, it would be advantageous to provide a cutting element mechanism or apparatus that provides for ease of replacement or flexibility of design. Also, it may be advantageous to provide a cutting element retention mechanism and method that avoids directly brazing the cutting element to a drill bit.

SUMMARY OF THE INVENTION

One aspect of the present invention relates to a cutting element assembly for use on a rotary drill bit for forming a borehole in a subterranean formation. Particularly, a cutting element assembly according to the present invention may comprise a cutting element comprising a substrate having a layer of superabrasive material disposed on an end surface thereof, the substrate extending from the end surface to a back surface thereof and a base member affixed to the back surface of the substrate, wherein the base member includes a recess configured to secure the base member to a rotary drill bit. The present invention also contemplates various aspects that a base member may exhibit. For example, in one embodiment, at least a portion of an exterior of the base member may be tapered (e.g., substantially frustoconical). In another embodiment, a base member may be substantially cylindrical. Further, a structural element may be coupled to the recess of the base member. Optionally, an inner member may be positioned within the recess of the base member. As a further option, a structural element may be coupled to the inner member.

Another aspect of the present invention relates to a rotary drill bit for drilling a subterranean formation, wherein the rotary drill bit includes a cutting element assembly according to the present invention. Particularly, a cutting element assembly may be coupled to a bit body of a rotary drill bit. In one aspect of the present invention, a structural element may be structured for generating a force on the base member in a direction substantially perpendicular to a cutting face of the cutting element. Thus, in one embodiment, a force may be applied to the base member to bias the base member into a recess formed in the bit body.

A further aspect of the present invention relates to a method of securing a cutting element to a rotary drill bit for drilling a subterranean formation. Specifically, a cutting element assembly may be provided including a cutting element comprising a substrate including a layer of superabrasive material disposed on an end surface of the substrate and a base member affixed to a back surface of the substrate. Further, the base member may be positioned within the recess formed in the bit body and a force may be applied to the base member to bias the base member into the recess formed in the bit body.

Features from any of the above-mentioned embodiments may be used in combination with one another in accordance with the present invention. In addition, other features and advantages of the present invention will become apparent to those of ordinary skill in the art through consideration of the ensuing description, the accompanying drawings, and the appended claims.

DETAILED DESCRIPTION OF THE INVENTION

Generally, the present invention relates to a retention structure for securing a cutting element to a rotary drill bit for drilling a subterranean formation. In further detail, the present invention relates to a cutting element having a base member affixed to a back surface opposite of the cutting face of the cutting element. The base member includes an aperture for facilitating retention of a cutting element. The aperture may be configured for accepting a fastening or support element, wherein the fastening element extends from the aperture and may facilitate affixation, support, or securement of the cutting element to a rotary drill bit.

Figure 1:
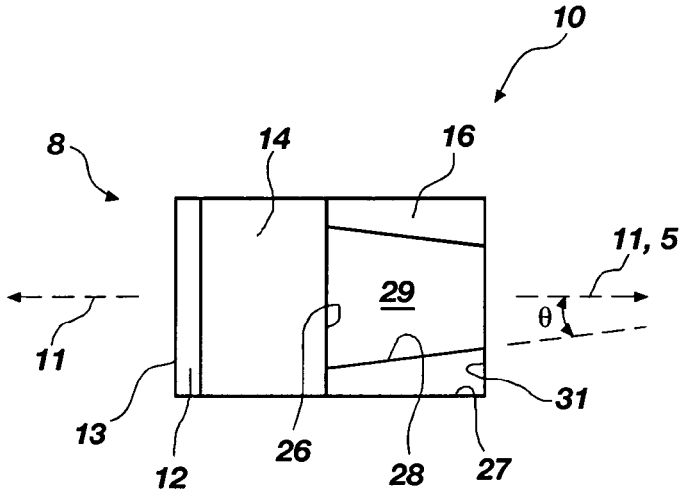
FIG. 1 shows a schematic side cross-sectional view of one embodiment of a cutting element assembly according to the present invention.

For example, FIG. 1 shows a side cross-sectional view of one embodiment of a cutting element assembly 10 according to the present invention. In further detail, a cutting element 8 may include a table 12 affixed to or formed upon a substrate 14. Cutting element 8 may comprise any cutting element of a type known in the art for drilling into a subterranean formation (e.g., a PDC cutter), without limitation. Typically, a layer or table 12 may be formed of a superhard or superabrasive material such as, for example, polycrystalline diamond. For example, cutting element 8 may include a table 12 comprising polycrystalline diamond while substrate 14 may comprise a cobalt-cemented tungsten carbide substrate. As known in the art, a catalyst material (e.g., cobalt, nickel, etc.) may be at least partially removed (e.g., by acid-leaching) from a table 12 comprising polycrystalline diamond. Cutting table 12 forms a cutting face 13, which is generally perpendicular to a central axis 11. Central axis 11 may be substantially centered (i.e., positioned at a centroid) with respect to a selected cross-sectional area (e.g., a solid cross-sectional area or a cross-sectional area bounded by an exterior surface, without limitation) of cutting element 8. In addition, a base member 16 may be affixed to the back surface 26 of substrate 14. For example, base member 16 may be affixed to the back surface 26 of substrate 14 by way of brazing. As shown in FIG. 1, base member 16 extends from back surface 26 of substrate 14 to back surface 31 of base member 16 and includes a recess 29 defined, at least in part, by interior surface 28. It should be further understood that base member also includes a central axis 5, which may be substantially aligned (substantially parallel and substantially collinear) with the central axis 11 of the cutting element 8. As further shown in FIG. 1, base member 16 may form a sleeve or tubular element wherein recess 29 exhibits a cross-sectional size that decreases with distance from back surface 26 of cutting element 8. Further, in one embodiment, base member 16 may be radially symmetric with respect to central axis 5. Thus, recess 29 may be generally frustoconical, wherein an angle θ is formed between central axis 11 and interior surface 28. In one embodiment, angle θ may be about 0° to 15°. Such a configuration may provide a robust structure for affixing the base member 16 to a rotary drill bit body, as discussed hereinbelow in further detail. In one embodiment, base member 16 may comprise cemented tungsten carbide. In such a configuration, base member 16 may be manufactured according to processes as known in the art. Also, such a configuration may provide suitable structural support for cutting element 8 during drilling into a subterranean formation. Optionally, base member 16 may comprise steel or another material suitable for supporting cutting element 8.

Figure 2:
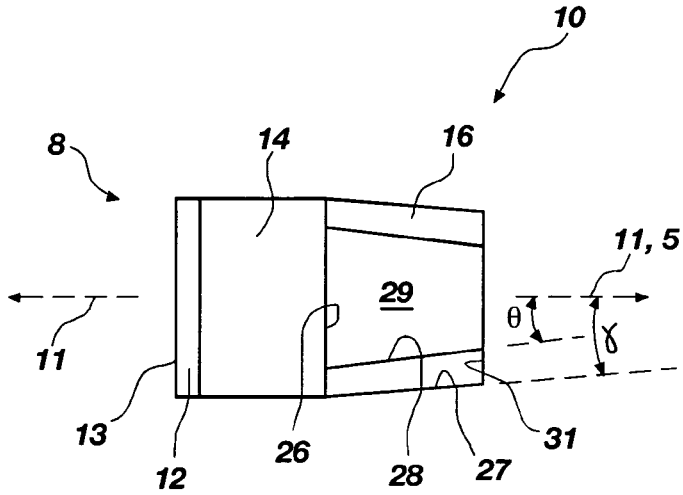
FIG. 2 shows a schematic side cross-sectional view of another embodiment of a cutting element assembly according to the present invention.

As shown in FIG. 1, base member 16 may have an exterior surface 27 that is substantially parallel to central axis 11 of the cutting element. Thus, in one embodiment, base member 16 may be substantially cylindrical. Of course, in other embodiments, exterior surface 27 may be generally rectangular, generally hexagonal, triangular, or any other cross-sectional shape (i.e., taken transverse to central axis 11) as may be desired, without limitation. In another embodiment, FIG. 2 shows a cutting element 8 and a base member 16 wherein the exterior surface 27 of the base member 16 is nonparallel with respect to central axis 11. Put another way, exterior surface 27 of base member 16 may be tapered so that a cross-sectional size thereof decreases with respect to an increasing distance from back surface 26 of cutting element 8. Accordingly, if base member 16, as shown in FIG. 2, is substantially symmetric about central axis 11, base member 16 may be substantially frustoconical, wherein an angle γ is formed between central axis 11 and exterior surface 27. In one embodiment, angle γ may be about 0° to 15°. Such a frustoconical shape may be advantageous for mating within a corresponding recess formed within a rotary drill bit body, as discussed in further detail hereinbelow.

Figure 3:
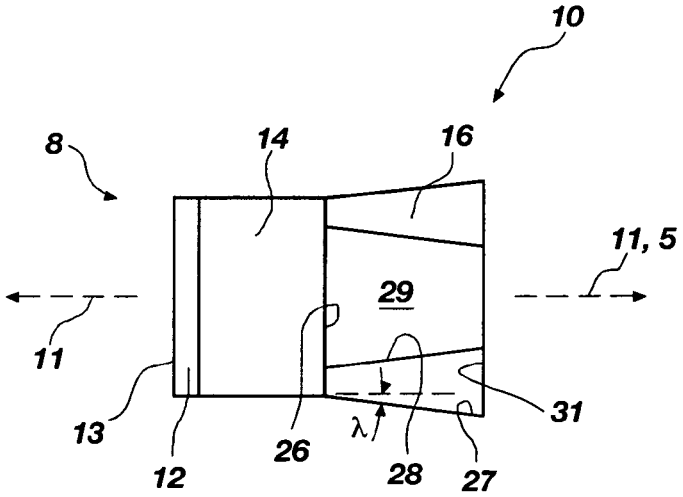
FIG. 3 shows a schematic side cross-sectional view of a further embodiment of a cutting element assembly according to the present invention.

FIG. 3 shows a side cross-sectional view of a further embodiment of a cutting element assembly 10 according to the present invention. Particularly, exterior surface 27 of base member 16 may be tapered so that a cross-sectional size thereof increases with respect to an increasing distance from back surface 26 of cutting element 8. Accordingly, if base member 16 is substantially symmetric about central axis 11, base member 16 may be substantially frustoconical wherein an angle λ is formed between central axis 11 and exterior surface 27. In one embodiment, angle λ may be about 0° to 15°. Such a frustoconical shape may be advantageous for mating within a corresponding recess formed within a rotary drill bit body, as discussed in further detail hereinbelow.

Figure 4:
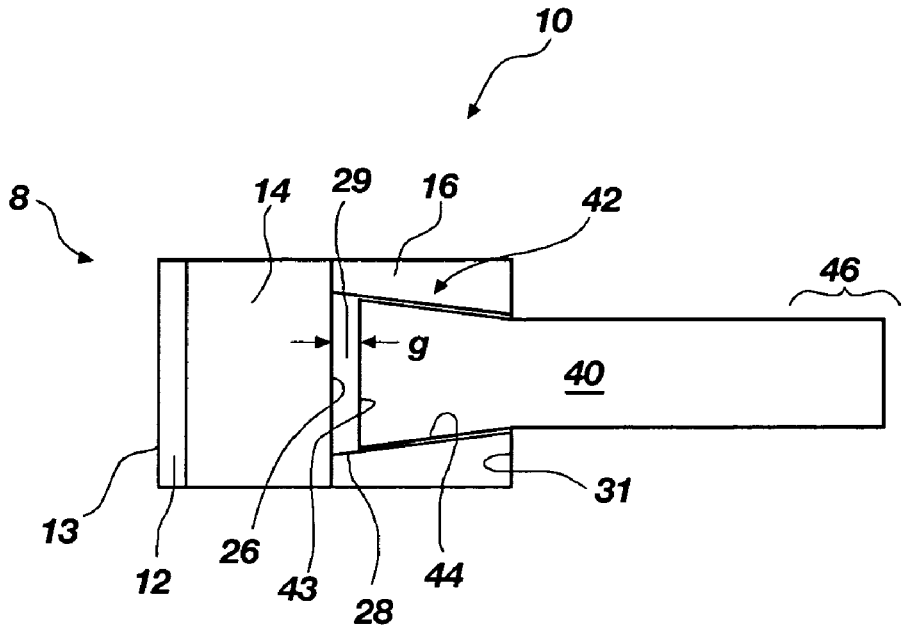
FIG. 4 shows a schematic side cross-sectional view of the cutting element assembly shown in FIG. 1, including a structural element coupled thereto.
Figure 5:
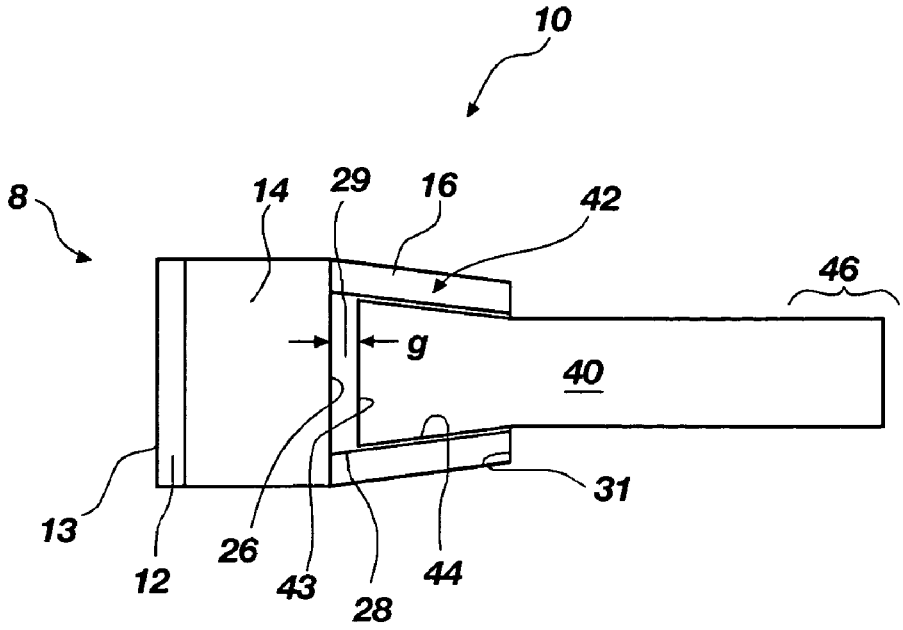
FIG. 5 shows a schematic side cross-sectional view of the cutting element assembly shown in FIG. 2, including a structural element coupled thereto.

The present invention further contemplates, in one embodiment, that a structural element may be employed in combination with the cutting element retention structures or assemblies for securing or supporting a cutting element within a rotary drill bit body. For example, in one embodiment, a structural element may include an enlarged end that is sized and configured for fitting within a recess of a base member. More specifically, FIG. 4 shows a side cross-sectional view of one embodiment of a structural element 40 positioned within recess 29 of base member 16 as shown and described above with respect to FIG. 1. As shown in FIG. 4, structural element 40 includes an enlarged end 42 defined by tapered surface 44, wherein the enlarged end 42 is positioned within recess 29 of base member 16. Structural element 40 may be positioned within recess 29 prior to affixing the base member 16 to the substrate 14. Also, as shown in FIG. 4, structural element 40 may be sized to provide a gap "g" between the back surface 26 of the cutting element 8 and the leading surface 43 of the structural element 40. Further, at least a portion of tapered surface 44 may be substantially congruent (i.e., complimentary or substantially parallel) to at least a portion of interior surface 28 of base member 16. Such a configuration may provide a relatively robust and effective locking mechanism therebetween. Optionally, at least a portion of tapered surface 44 may be affixed to at least a portion of interior surface 28 by way of adhesive, brazing, welding, mechanical fasteners, mechanical affixation, or as otherwise known in the art. Further, structural element 40 may extend from base member 16 and may have an end region 46 structured for facilitating affixation of the cutting element 8 to a rotary drill bit, as discussed in greater detail hereinbelow. In one embodiment, end region 46 of structural element 40 may be threaded to facilitate affixing or securing the cutting element assembly 10 to a rotary drill bit. Similarly, FIG. 5 shows a side cross-sectional view of one embodiment of structural element 40 positioned within recess 29 of a base member 16 as shown and described above with respect to FIG. 2. As described above, structural element 40 may include an enlarged end 42 positioned within recess 29 of base member 16 and, optionally, which may be affixed to one another. Structural element 40 may be positioned within recess 29 prior to affixing the base member 16 to the substrate 14.

Figure 6:
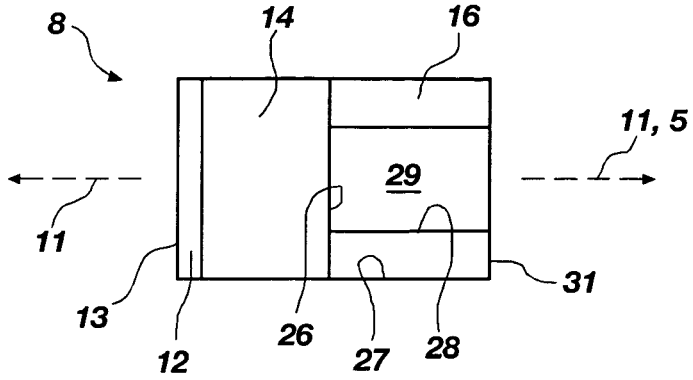
FIGS. 6-12 each show respective schematic side cross-sectional views of different embodiments a cutting element assembly according to the present invention.
Figure 7:
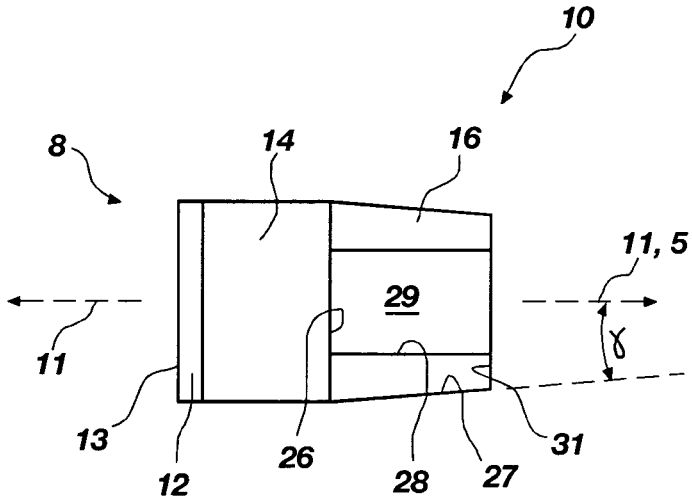
Figure 8:
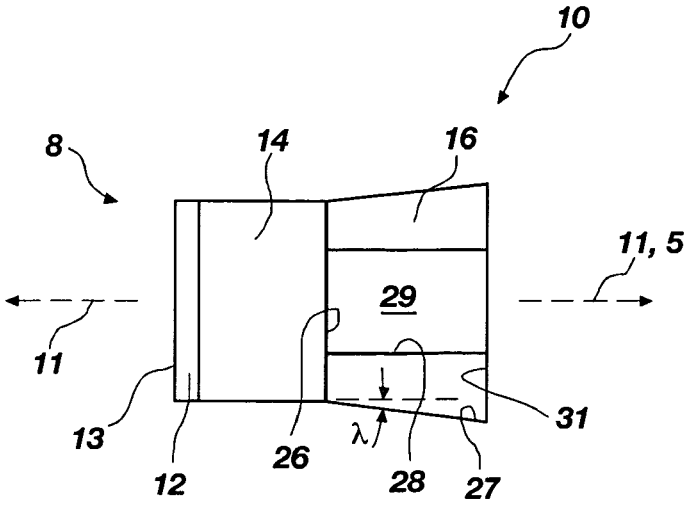

It should be appreciated that the present invention contemplates that variations of the retention structures described hereinabove may be employed. For example, the present invention contemplates that an interior surface of a base member may be substantially parallel with a central axis of the cutting element so that a cross-sectional size of an aperture defined therein may generally remain constant with increasing distance from the back surface of the cutting element to which the base member is affixed. For example, FIG. 6 shows a cutting element assembly 10 generally as described above in relation to FIG. 1, however, both interior surface 28 and exterior surface 27 of base member 16 may be generally parallel to central axis 11. Thus, in one embodiment, an exterior of base member 16 may be substantially cylindrical and recess 29 of base member 16 may be substantially cylindrical. FIG. 7 shows another embodiment of a cutting element assembly 10 which may be generally configured as described with respect to FIG. 6, but wherein exterior surface 27 of base member 16 may be tapered so that a cross-sectional size of the exterior surface 27 decreases with respect to an increasing distance from back surface 26 of cutting element 8. Accordingly, if base member 16 is substantially radially symmetric about central axis 11, base member 16 may be substantially frustoconical wherein an angle γ is formed between central axis 11 and exterior surface 27. FIG. 8 shows another embodiment of a cutting element assembly 10 according to the present invention, which may be configured generally as described with respect to FIG. 6, but may include an interior surface 28 that is generally parallel to central axis 11 and an exterior surface 27 that may be tapered so that a cross-sectional size thereof increases with respect to an increasing distance from back surface 26 of cutting element 8. Accordingly, if base member 16 is substantially radially symmetric about central axis 11, base member 16 may be substantially frustoconical wherein an angle λ is formed between central axis 11 and exterior surface 27.

Figure 9:
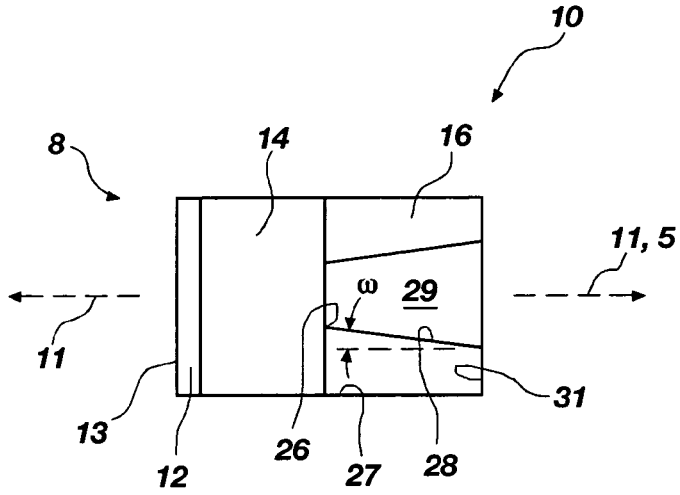
Figure 10:
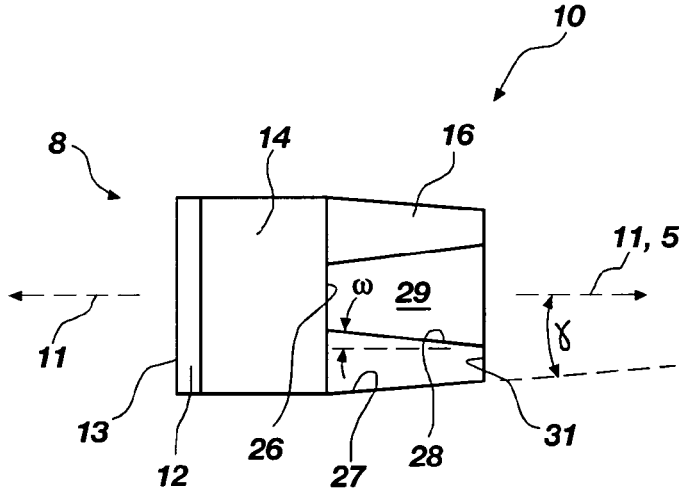
Figure 11:
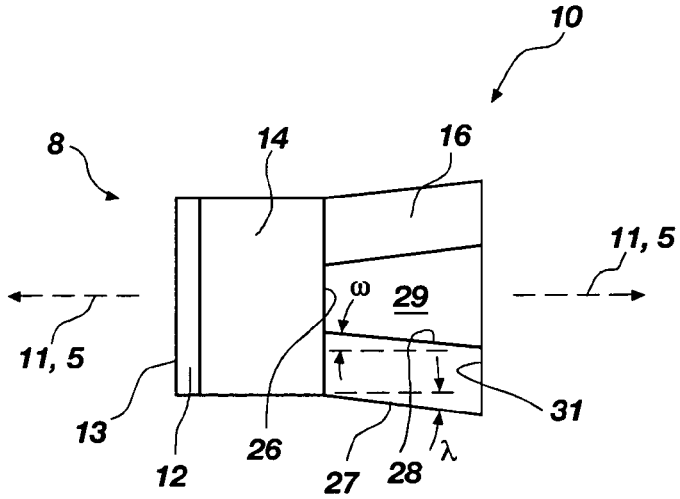

In other embodiments, the present invention contemplates that an interior surface of a base member may be tapered so that a cross-sectional size of an aperture defined by the base may generally increase with increasing distance from the back surface of the cutting element to which the base member is affixed. For example, FIG. 9 shows a side cross-sectional view of a cutting element assembly 10 according to the present invention generally as described above in relation to FIG. 1, however, interior surface 28 tapers such that a cross-sectional size of recess 29 increases with respect to an increasing distance from back surface 26 of cutting element 28. Thus, if base member 16 is substantially radially symmetric about central axis 11, recess 29 of base member 16 may be substantially frustoconical wherein an angle ω is formed between central axis 11 and interior surface 28. FIG. 10 shows a side cross-sectional view of a cutting element assembly 10 according to the present invention generally as described above in relation to FIG. 9, however, exterior surface 27 of base member 16 may be tapered so that a cross-sectional size of the base member 16 decreases with respect to an increasing distance from back surface 26 of cutting element 8. Accordingly, if base member 16 is substantially radially symmetric about central axis 11, base member 16 may be substantially frustoconical wherein an angle γ is formed between central axis 11 and exterior surface 27. FIG. 11 shows another embodiment of a assembly 10 according to the present invention, which may be configured generally as described with respect to FIG. 9, but may include an exterior surface 27 that may be tapered so that a cross-sectional size of the base member 16 increases with respect to an increasing distance from back surface 26 of cutting element 8. Accordingly, if base member 16 is substantially radially symmetric about central axis 11, base member 16 may be substantially frustoconical wherein an angle λ is formed between central axis 11 and exterior surface 27.

Figure 12:
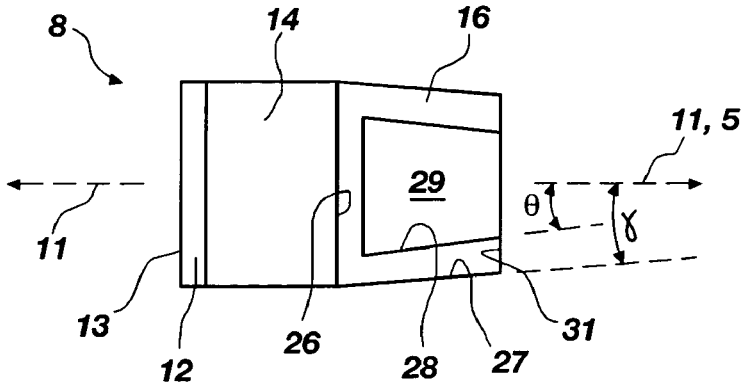
Figure 13:
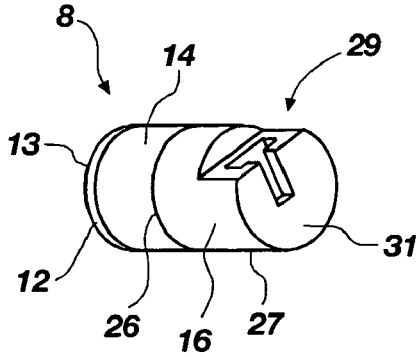
FIGS. 13 and 14 each show a perspective view of a cutting element assembly including a T-slot shaped recess and a dove-tail shaped recess, respectively.
Figure 14:
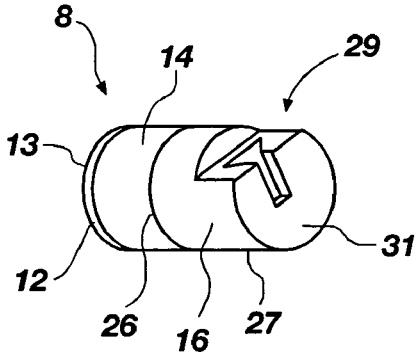

In yet another aspect of the present invention, a recess may be formed that does not extend through the base member. For example, FIG. 12 shows one embodiment wherein recess 29 is formed within, but not completely through, base member 16. Of course, interior surface 28 and exterior surface 27 of base member 16 may be configured as described above with respect to FIGS. 1-3 and 6-11. In other embodiments, a recess (e.g., recess 29) formed in a base member may embody any groove or channel structured for mechanically coupling structures to one another as known in the art. For example, as shown in FIG. 13, a so-called T-slot-shaped recess 29 may be formed within base member 16. It should be understood that a structural element (e.g., 40) may be coupled to recess 29 directly or via a separate member (e.g., an inner member 50 as discussed below) positioned within recess 29 or an end of the structural element that is configured for being positioned within recess 29 to couple the structural element thereto. Similarly, FIG. 14 shows a base member including a so-called dove-tail shaped recess 29. Of course, a structural element (e.g., 40) may be coupled to recess 29 through or a separate member (e.g., an inner member 50 as discussed below) positioned within recess 29 or an end of the structural element that is configured for being positioned within recess 29.

Figure 15:
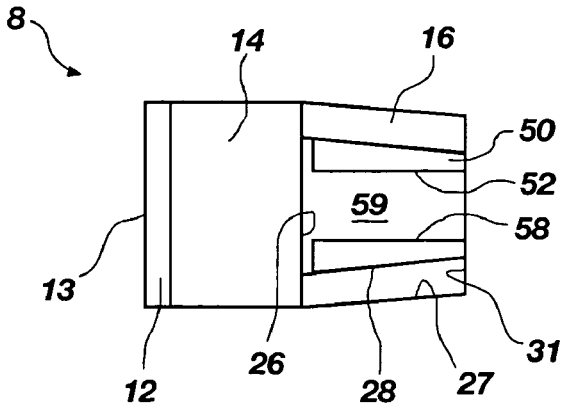
FIG. 15 shows a schematic side cross-sectional view of one embodiment of a cutting element assembly according to the present invention including an inner member positioned within a base member.

In a further aspect of the present invention, an inner member may be positioned within a base element. For example, in one embodiment, FIG. 15 shows a cutting element assembly 10 according to the present invention in a side cross-sectional view. Particularly, a base member 16 may be configured and affixed to cutting element 8. Of course, base member 16 may be configured according to any embodiment as described above with reference to any of FIGS. 1-3 and 6-11. As shown in FIG. 15, inner member 50 is defined by an exterior surface 58 and an interior surface 52, wherein the interior surface 52 defines an aperture 59 extending through the inner member 50. In addition, an inner member 50 may be positioned within base member 16. Further, optionally, inner member 50 may be affixed to base member 16. For example, inner member 50 may be affixed to base member 16 by way of an adhesive, brazing, welding, mechanical affixation, or as otherwise known in the art. Inner member 50 may comprise a material that is more ductile than base member 16. In such a configuration, inner member 50 may be more easily machined or otherwise fabricated than base member 16. In addition, it may be desirable for base member 16 to exhibit a relatively high modulus of elasticity (e.g., 45,000 ksi or more). In one embodiment, base member 16 may exhibit a modulus of elasticity of about 95,000 ksi. to about 105,000 ksi. Such a configuration may allow for suitable mechanical support of cutting element 8 during drilling operations. Inner member 50 may have a modulus of elasticity of about 15,000 ksi up to about 70,000 ksi. Such a modulus of elasticity may provide a level of compliance within a cutting element retention assembly according to the present invention. The present invention contemplates, in one embodiment, that base member 16 may comprise a cemented tungsten carbide, while inner member 50 may comprise a steel alloy (e.g., an AISI 4140 steel alloy, an AISI 1040 steel alloy, an UNS S17400 steel alloy, etc.).

Further, inner member 50 may be structured for facilitating selective securement or removal of a cutting element to or from, respectively, a rotary drill bit by way of a fastening element. More particularly, in one embodiment, the inner surface 52 of inner member 50 may be threaded. In such a configuration, a structural element (e.g., a fastening element) may include a complementarily threaded surface for coupling to the inner surface 52. In another embodiment, inner member 50 may include a so-called bayonet-type locking configuration or other male/female type mechanical interconnection, as known in the art. In such a configuration, a structural element may include features for a so-called bayonet-type locking configuration. In other embodiments, interlocking or interconnecting structures may be formed upon or within inner member 50 and may be structured for mechanically coupling to corresponding interlocking or interconnecting structures formed on a structural element. Thus, generally, the present invention contemplates that inner member 50 may be structured for coupling to a structural element to positively engage or couple therewith. Further, structural element 70 may have an end region 76 structured for facilitating affixation of the cutting element 8 to a rotary drill bit, as discussed in greater detail hereinbelow. In one embodiment, end region 76 of structural element 70 may be threaded to facilitate affixing or securing the cutting element 8 to a rotary drill bit.

Figure 16:
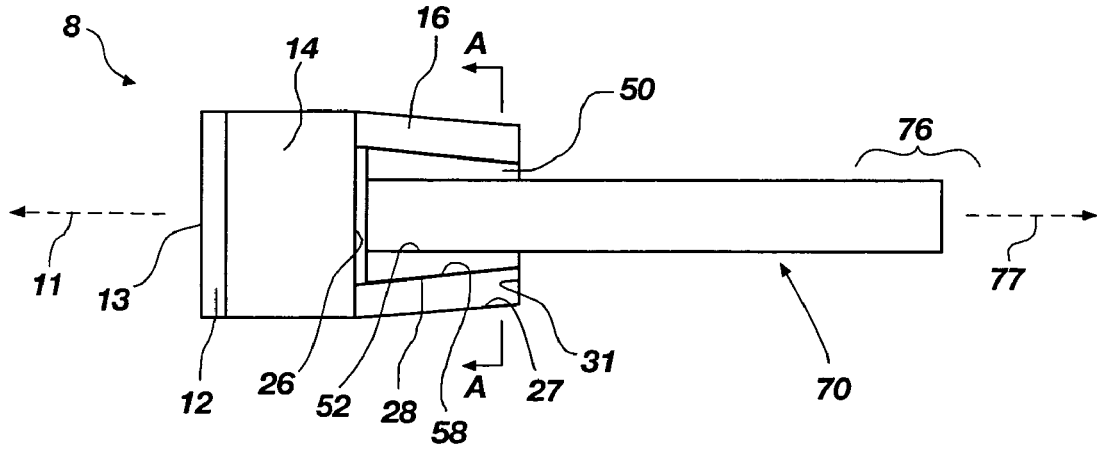
FIG. 16 shows a schematic side cross-sectional view of another embodiment of a cutting element assembly according to the present invention including an inner member positioned within a base member and a structural element coupled to the inner member.
Figure 16B:
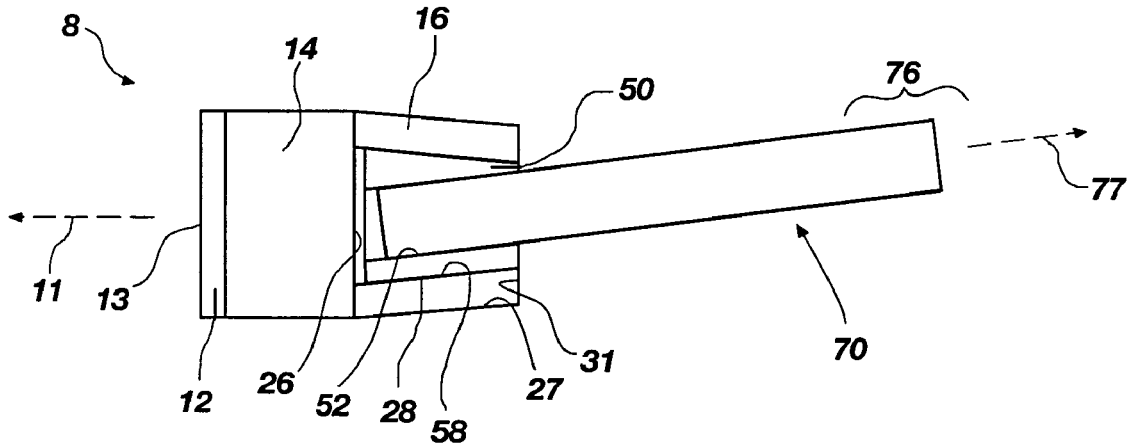
FIG. 16B shows a schematic side cross-sectional view of a further embodiment of a cutting element assembly according to the present invention including an inner member positioned within a base member and a structural element coupled to the inner member.
Figure 16C:
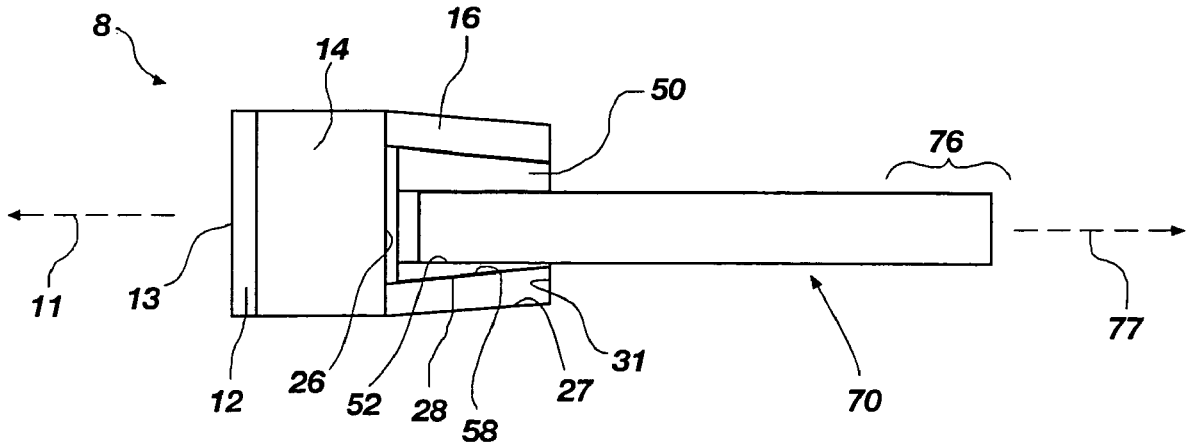
FIG. 16C shows a schematic side cross-sectional view of an additional embodiment of a cutting element assembly according to the present invention including an inner member positioned within a base member and a structural element coupled to the inner member.

More particularly, FIG. 16 shows a schematic side cross-sectional view of the retention assembly shown in FIG. 15 wherein a structural element 70 is positioned within and coupled to inner member 50. Structural element 70 may be mechanically coupled to inner member 50 to prevent longitudinal displacement relative to one another. For example, structural element 70 may be brazed, adhesively affixed, or welded to inner member 50. In another embodiment, inner member 50 may be mechanically coupled to inner member 50 as known in the art (e.g., via a pin, a snap ring, a rivet, etc.). Structural element 70 may extend from base element 16 substantially perpendicularly with respect to central axis 11 of the cutting element 8. However, it should be further appreciated that inner member 50 may be configured so that a structural element 70 extends at an angle, is offset, or is both nonparallel and offset with respect to a central axis 11 of the cutting element 8. For example, FIG. 16B shows a structural element 70 extending along a longitudinal axis 77 that is substantially nonparallel to central axis 11 of cutting element 8. In another embodiment, as shown in FIG. 16C, a structural element 70 extending along a longitudinal axis 77 that is substantially parallel but is not collinear (i.e., offset) with central axis 11 of cutting element 8.

Figure 17:
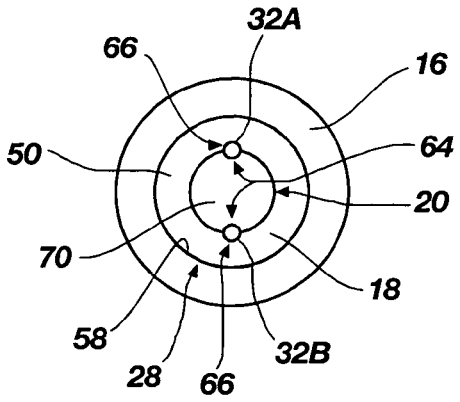
FIG. 17 shows a schematic cross-sectional view of the cutting element assembly shown in FIG. 17.

In another embodiment, structural element 70 may be threaded and the inner surface 52 of inner member 50 may be threaded. In such a configuration, inner member 50 and base member 16 may be structured for preventing relative rotation with respect to one another. Explaining further, preventing relative rotation between inner member 50 and base member 16 may prevent inner member 50 and structural element 70 from becoming loosened. Generally, friction between inner member 50 and base member 16 may prevent relative rotation therebetween. In another embodiment, inner member 50 and base member 16 may be affixed to one another or otherwise configured to inhibit relative rotation therebetween. Further, inner member 50 and structural element 70 may include recesses that may be aligned to form passageways for accepting locking elements. For example, FIG. 17 shows an enlarged schematic end view taken transverse to central axis 11, wherein a locking element 60 is positioned within each of passageways 66 formed by recesses 64 and recesses 68, respectively. Such a configuration may resist relative rotation of structural element 70 with respect to inner member 50. Of course, other locking mechanisms are contemplated by the present invention such as, for example, mechanically or adhesively coupling inner member 50 and base member 16, or any locking or self-locking fastener as known in the art. For example, locking or self-locking fasteners may be commercially available from Long-Lok Fasteners Corporation of Hawthorne, Calif.

Figure 18:
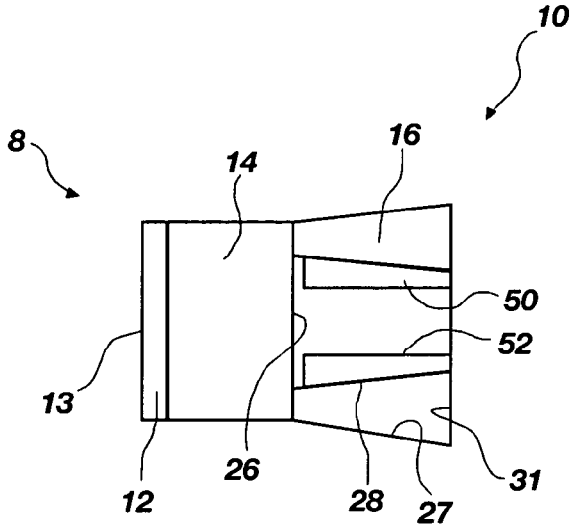
FIGS. 18 and 19 each show respective schematic side cross-sectional views of different embodiments a cutting element assembly including an inner member according to the present invention.
Figure 19:
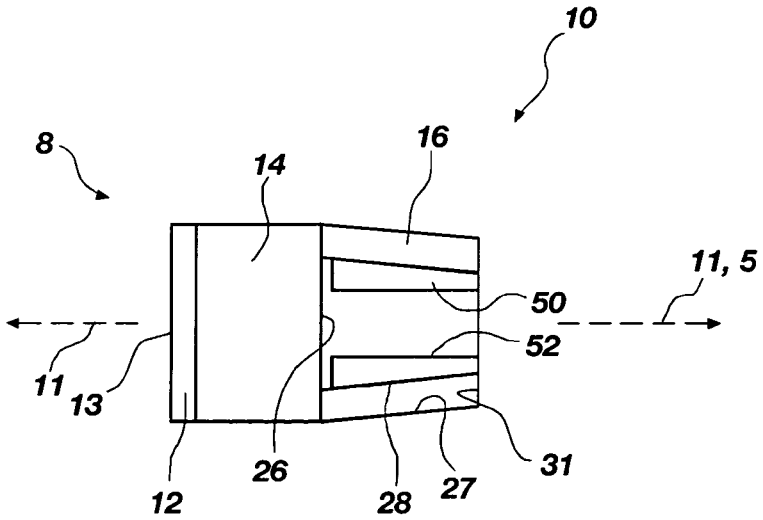

It should be understood that any of the above-described embodiments of base member 16 may be employed in combination with an inner member 50. Thus, while FIGS. 18 and 19 show embodiments of base members 16 as shown in FIGS. 3 and 2, respectively, including an inner member 50 positioned within recess 29, an inner member 50 may be configured for use in combination with any base member 16 contemplated by the present invention. If, for instance, a base member has an interior surface 28 that is substantially parallel to a central axis of the cutting element to which it is attached, an inner member may be press-fit, brazed, or otherwise mechanically affixed to the base member. In addition, it should be understood that an inner member may be structured for applying a force generally toward a cutting face of a cutting element if so desired. Thus, as may be appreciated by the varied embodiments and aspects of the present invention, different structural aspects of base member 16 may afford various advantages and features with respect to securing a cutting element 8 to a rotary drill bit for subterranean drilling.

Thus, the present invention relates to structures for affixing cutting elements to a rotary drill bit for subterranean drilling. As used herein, the term "drill bit" includes and encompasses core bits, roller-cone bits, fixed-cutter bits, eccentric bits, bicenter bits, reamers, reamer wings, or other earth-boring tools as known in the art. Generally, the present invention contemplates that a recess formed in a base member may be employed for mechanically coupling a cutting element to a rotary drill bit. Conventionally, cutting elements are typically brazed within a rotary drill bit. Accordingly, one advantage of the present invention may relate to mechanically coupling a cutting element to a rotary drill bit without brazing the cutting element thereto. Such mechanical coupling of a cutting element to a rotary drill bit may avoid thermal damage and the processes accompanying brazing a cutting element to a rotary drill bit.

Figure 20:
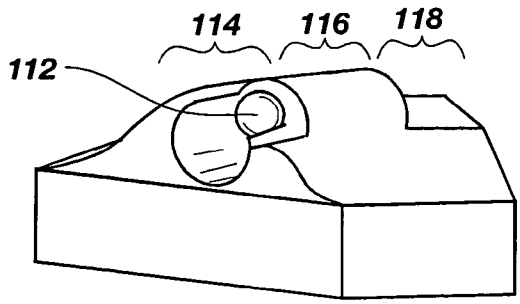
FIG. 20 shows a partial perspective view of a bit blade including a recess for accepting a cutting element assembly according to the present invention.

FIG. 20 shows a partial perspective view of one embodiment of a bit blade 110 having a recess 112 formed therein sized and configured to accept a base element affixed to a cutting element (e.g., a PDC cutter). In addition, FIG. 20 shows a cutting pocket portion 114 of bit blade 110, a support portion 116 of bit blade 110, and an anchor portion 118 of bit blade 110. Cutting pocket portion 114 of bit blade 110 may be generally configured for surrounding at least a portion of a cutting element positioned therein and may inhibit erosion of a substrate of such a cutting element (e.g., a PDC cutter) due to flow of drilling fluid. Support portion 116 of bit blade 110 may include recess 112 and may be further structured for accepting and generally supporting a base member positioned therein. Further, support portion 116 may be configured for accommodating a structural element for applying a force to a base member positioned within recess 112, as discussed in greater detail below. Anchor portion 118 of bit blade 110 may be structured for providing a structure for coupling a structural element thereto to apply a force to a base member positioned within recess 112.

Figure 21:
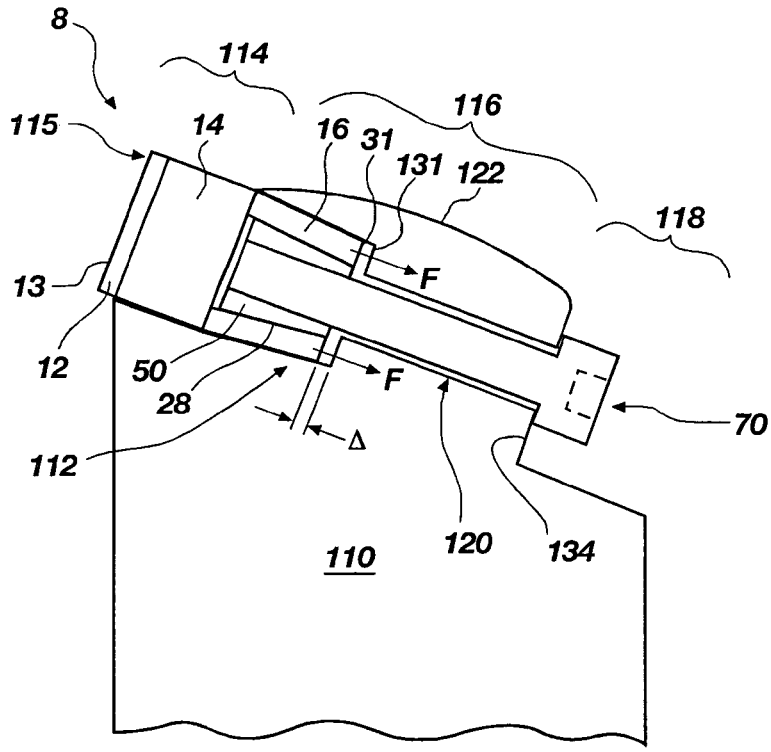
FIG. 21 shows a schematic side cross-sectional view of one embodiment of a bit blade as shown in FIG. 20 including one embodiment of a cutting element assembly coupled thereto.

FIG. 21 shows a side cross-sectional view of the bit blade 110 shown in FIG. 20, wherein a cutting element assembly 10, as shown in FIG. 16, is positioned therein. More specifically, cutting element 8 is positioned generally within cutting pocket portion 114 and base member 16 is positioned generally within recess 112 formed within support portion 116. As may also be seen in FIG. 21, the uppermost tip 115 of the cutting face 13 of the cutting element 8 may be positioned above the upper surface 122 of the bit blade 110, to provide clearance therebetween. Such clearance may be desirable so that the cutting element 8 contacts the subterranean formation to be drilled, thus cutting and removing material from the formation. Excessive contact between the bit blade 110 and a formation may inhibit cutting by the cutting element(s) on a rotary drill bit. Of course, the upper surface 122 of bit blade 110 may be structured for contacting a subterranean formation during drilling to limit a depth-of-cut (i.e., a rate-of-penetration) of a cutting element associated therewith, as known in the art. Further, cutting face 13 of cutting element 8 may be disposed at a back rake angle and a side rake angle as known in the art. Explaining further, as known in the art, cutting elements, such as PDC cutters, may be typically oriented so that a cutting face thereof exhibits a negative back rake angle, or, in other words, so that the cutting face leans away from the surface of the formation during drilling. Also, typically, a cutting element may be oriented at a negative side rake angle. Such negative back rake, side rake, or both may reduce or inhibit premature failure or damage to PDC cutters. Further, a cutting element 8 may be located at a given radius on a bit crown and will traverse through a helical path upon each revolution of the drill bit during drilling. The geometry (pitch) of the helical path is determined by the rate of penetration of the bit (ROP) and the rotational speed of the drill bit. The pitch affects the so called "effective back rake" of the cutting element, because it affects the geometry of the surface of the formation and the trajectory of the cutting element 8, as known in the art. Further, a PDC cutter may include a chamfer or buttress or may embody any other cutting edge geometry as known in the art, without limitation.

As shown in FIG. 21, recess 112 of a bit blade 110 may be structured for accepting a base member 16 having a tapered exterior so that a cross-sectional size of the base member 16 decreases with respect to an increasing distance from back surface 26 of cutting element 8. Put another way, at least a portion of recess 112 may be tapered to substantially correspond to (i.e., being congruent with) at least a portion of the tapered exterior surface 27 of base member 16. Such a configuration reduce tensile stress in the bases member 16 when it is biased into the recess 112. Put another way, such a configuration may promote compressive stress within base member 16, which may be beneficial for avoiding failure of the base member 16 under loading associated with drilling a subterranean formation with the cutting element 8. Thus, in one embodiment, each of base member 16 and recess 112 may be substantially. frustoconical. Further, optionally, a gap A may exist between a back surface 31 of base member 16 and back surface 131 of recess 112.

In addition, structural element 70 may extend between inner member 50 and a back surface 134 of bit blade 110. Structural element 70 may comprise a fastener as known in the art. More particularly, in one embodiment, as shown in FIG. 21, structural element 70 may comprise a bolt or machine screw (e.g., a so-called socket-head cap screw). In other embodiments, structural element 70 may comprise any threaded fastener as known in the art, without limitation. Structural element 70 may be effectively fixed to or against one end of through hole 120 (i.e., against back surface 134 of bit blade 110), so that a force, labeled F, may be generated on base member 16. Force F is shown schematically in two places in FIG. 21, but may actually be generated as a single force along contacting portions of interior surface 28 of base member 16 and exterior surface 58 of inner member 50. Such a force F may bias the tapered base member 16 into the recess 112, which may effectively lock or couple the base member 16 therein. In such a configuration, force F may be developed by rotating the structural element 70 (in contact with surface 134 of bit blade 110) to pull structural element 70 generally away from cutting element 8. In turn, inner member 50 may develop a force F on the base member 16. As shown in FIG. 21, force F may be substantially perpendicular to the cutting face 13 of the cutting element 8 and may be oriented in a direction generally away from the cutting face 13 of the cutting element 8. Such a force F may be sufficient for retaining cutting element 8 within bit blade 110 during drilling of a subterranean formation therewith. Further, force F may have a selected magnitude. For example, a force F may have a magnitude less than about 10,000 lbs. In one embodiment, force F may be between about 3,000 lbs. and about 4,000 lbs. In one process, a selected torque may be applied to a threaded element (e.g., a structural element, anchor element, or other threaded member) for generating a selected force F upon base member 16. In another process, a force may be applied to cutting element 8 and the structural element 70 may be affixed to the bit blade 110. Upon releasing the force to the cutting element 8, a force F may be generated upon base member 16 by the structural element 70 affixed to the bit blade 110. Such a configuration may be advantageous, because a cutting element 8 may be coupled to and removed from a bit blade 110 without heating processes associated with brazing the cutting element 8 to the bit blade 110.

Of course, other processes may be employed for producing a force F on base member 16. For instance, a force may be applied to structural element 70 by mechanical devices (e.g., a cam mechanism, a hydraulic piston, or any other device for developing a force upon structural element 70 as known in the art) and the structural element 70 may be affixed to or otherwise mechanically locked or coupled to the bit blade 110 to generate a selected magnitude of force upon base element 16. For example, structural element 70 may be brazed, deformed, pinned, or otherwise affixed or mechanically locked to the bit blade 110 to generate a selected magnitude of force upon base element 16. Even if brazing is employed for affixing structural element 70 to a bit blade 110, such brazing may be beneficial in comparison to conventional brazing of a substrate of a cutting element to the bit blade, because the heating may be at least partially localized to the structural element 70 (i.e., not directly applied to cutting element 8). In another alternative, it should be understood that a force of a desired magnitude may be applied to the cutting face 113 of the cutting element 8 to force the base member 16 into the recess 112 while affixing or otherwise mechanically locking the structural element 70 to the bit blade 110. It should be understood that FIGS. 20 and 21 illustrate a cutting element 8 that may comprise a generally cylindrical cutting element. Further, while FIG. 20 shows an exemplary schematic cross-sectional view of bit blade 110, the bit blade 110 shape may be tapered, rounded, or arcuately shaped in extending from a bit body as may be desired or as known in the art.

Figure 21B:
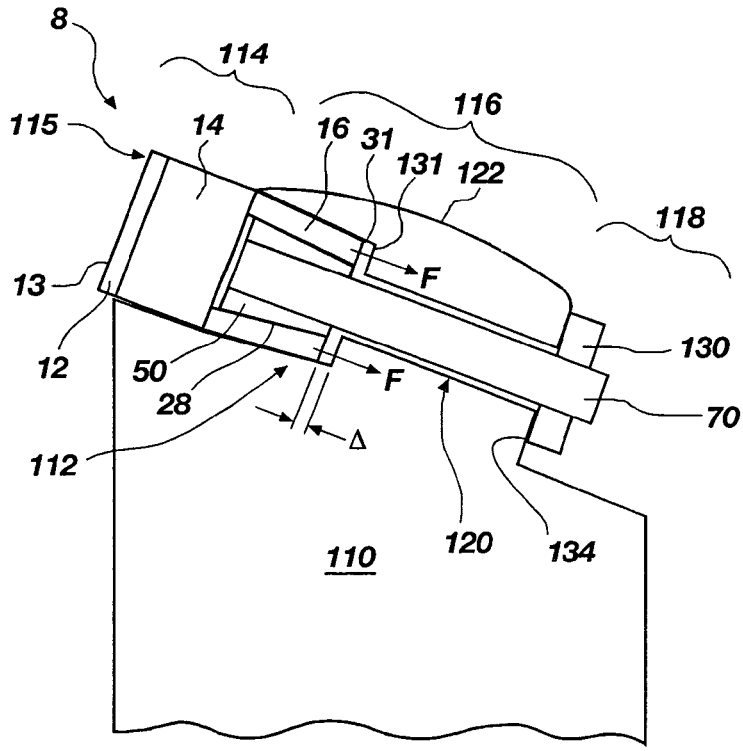
FIG. 21B shows a schematic side cross-sectional view of a further embodiment of a bit blade as shown in FIG. 20 including one embodiment of a cutting element assembly coupled thereto.

In another embodiment, as shown in FIG. 21B, structural element 70 may have a threaded end (e.g., threaded end region 76 as shown in FIG. 16) that engages anchor element 130, which may comprise a threaded nut. Of course, lock washers or other elements that are used in combination with fasteners (as known in the art) may be employed in combination with structural element 70. Such a configuration may provide relative flexibility and ease of use of a cutting element retention structure according to the present invention.

Figure 21C:
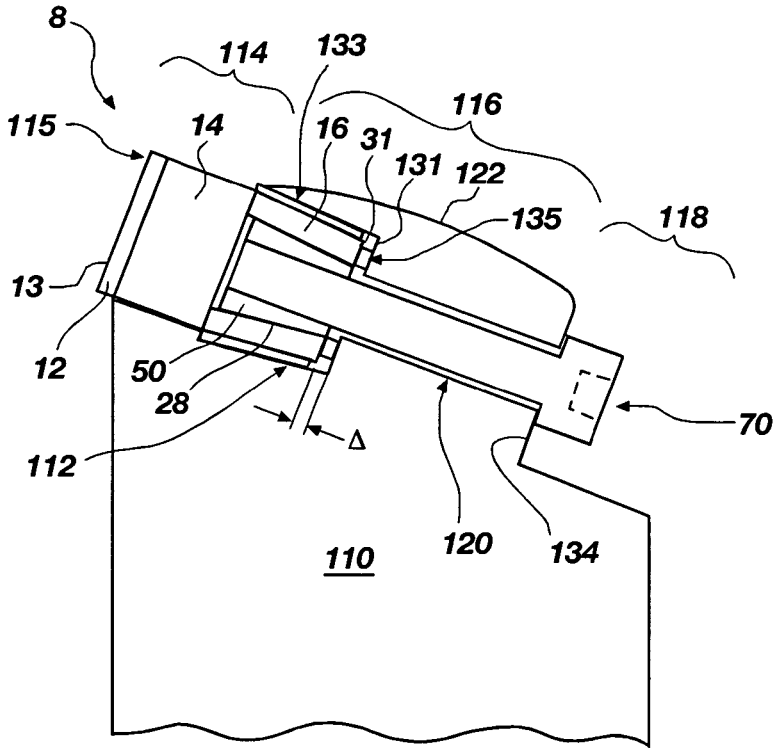
FIG. 21C shows a schematic side cross-sectional view of another embodiment of a bit blade as shown in FIG. 20 including a deformable element and a deformable layer positioned between the base element and the recess.

Additionally and optionally, as shown in FIG. 21C, a washer element may be positioned between the back surface 131 of recess 112 and a back surface 31 of base member 16. For example, a deformable element 135 (e.g., a deformable washer) may be positioned between the back surface 131 of recess 112 and a back surface 31 of base member 16. Similarly, optionally, as shown in FIG. 21C, a deformable layer 133 or material may be positioned between the exterior surface 27 of the base member 16 and the recess 112 of the bit blade 110. For example, a layer (e.g., a shim) of material may be positioned between the base member 16 and the recess 112 and then the base member 16 may be positioned in a desired position within recess 112. In one embodiment, the layer of material may comprise a solid metal shim or other material shim as known in the art. In a further embodiment, the layer of material may comprise a porous metal, a metal mesh or wire mesh, a powdered metal, a metal having a desired level of porosity, or another material having a suitable level of deformability or compliance. In another embodiment, a coating (e.g, a metal, such as for instance, copper, nickel, etc.)may be formed (e.g., electroplated, thermally sprayed, sputtered, electrolessly deposited, or otherwise formed or deposited as known in the art) upon at least a portion of the exterior surface 27 of the base member or upon a surface of the recess 112, or both. Such a configuration may facilitate relatively uniform contact between the recess 112 and the base member 16. Also, such a deformable material, a deformable washer, or both may provide compliance or tolerance for inaccuracies in manufacturing either of the recess 112 or the base member, or both, or may provide a mechanism for allowing relatively uniform contact between the recess 112 and the base member 16 despite wear or relatively slight changes to the shape or size of recess 112 (e.g., during use of a rotary drill bit.

Figure 22:
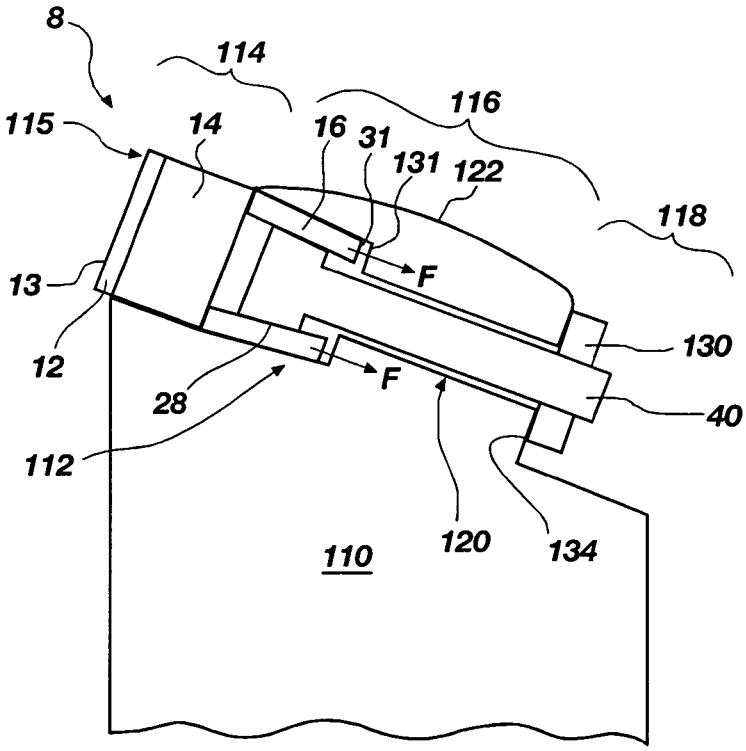
FIG. 22 shows a schematic side cross-sectional view of the embodiment of a bit blade as shown in FIG. 21 including a different embodiment of a cutting element assembly coupled thereto.

The present invention contemplates that any of the above-described embodiments of a base member affixed to a cutting element may be utilized for affixing such a cutting element to a rotary drill bit. For example, FIG. 22 shows bit blade 110 according to the present invention including a cutter assembly 10 generally as described and shown in FIG. 5. Thus, recess 112 of a bit blade 110 may be structured for accepting a base member 16 having a tapered exterior so that a cross-sectional size of the base member 16 decreases with respect to an increasing distance from back surface 26 of cutting element 8. Put another way, at least a portion of recess 112 may be tapered and may substantially correspond to at least a portion of the tapered exterior surface 27 of base member 16. Further, structural element 40 may extend between inner member 50 and anchor element 130 and may be effectively anchored at one end of through hole 120 by anchor element 130, so that a force, labeled F, may be generated on base member 16 in a direction that is generally away from cutting face 13 of cutting element 8. In one embodiment, structural element 40 may have a threaded end (e.g., threaded end region 76 as shown in FIG. 16) that engages anchor element 130, which may include a threaded recess (e.g., a threaded recess of a nut) for coupling to the structural element 40. In addition, a pin (e.g., cotter pin, a locking element as shown in FIG. 17), adhesives (e.g., LOCTITE®), or deformation (e.g., via peening), may be employed for preventing relative rotation of anchor element 130 with respect to structural element 40.

Figure 23:
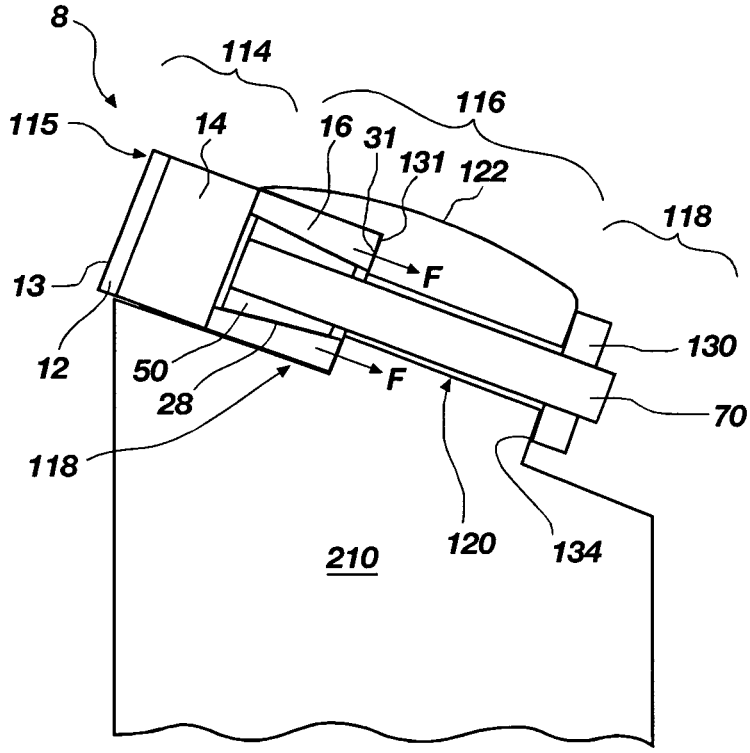
FIG. 23 shows a schematic side cross-sectional view of another embodiment of a bit blade as shown in FIG. 20 including yet a further embodiment of a cutting element assembly coupled thereto.

In a further embodiment of the present invention, a bit blade may include a recess that is structured for press-fitting of a base member therein. For example, FIG. 23 shows bit blade 210 according to the present invention including a cutter assembly 10 generally as described and shown in FIG. 5. Thus, recess 118 of a bit blade 210 may be structured for accepting a base member 16 having an exterior surface 27 that is substantially parallel to a central axis 11 of the cutting element 8. Optionally, recess 118 may be sized to exhibit interference with exterior surface 27 of base member 16. Such a configuration may provide a "press-fit" between the base member 16, which may effectively secure the base member 16 and cutting element 8 to bit blade 210. In addition, a back surface 31 of base element 16 may contact a back surface 131 for support of the base member 16 against the forces or moments created during drilling a subterranean formation with cutting element 8. Further, structural element 70 may extend between inner member 50 and anchor element 130 to secure base member 16 within bit blade 210. Optionally, a force, labeled F, may be generated on base member 16, if the press-fit between base element 16 and recess 118 is not sufficient for providing effective securement therebetween. Structural element 70 and anchor element 130 may be configured as described hereinabove.

Figure 24:
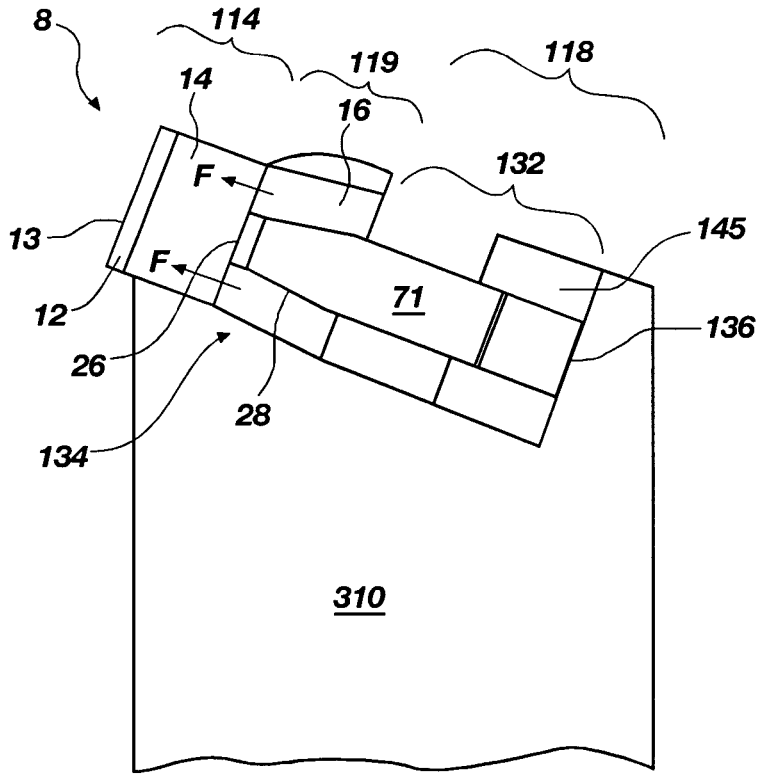
FIG. 24 shows a schematic side cross-sectional view of yet an additional embodiment of a bit blade according to the present invention including yet an additional embodiment of a cutting element assembly coupled thereto.

In a further embodiment of a base member affixed to a cutting element which may be utilized for affixing such a cutting element to a rotary drill bit, FIG. 24 shows bit blade 310 according to the present invention including a cutting pocket portion 114, a support portion 119, and a recessed portion 132. As shown in FIG. 24, recess 134 of bit blade 110 may be structured for accepting a base member 16 having a tapered exterior so that a cross-sectional size of the base member 16 increases with respect to an increasing distance from back surface 26 of cutting element 8. Put another way, if base member 16 is substantially frustoconical, recess 134 may be substantially frustoconical and may be sized to substantially correspond to at least a portion of the exterior surface 27 of base member 16. Further, structural element 71 may extend between inner member 50 and anchor element 145 and may be effectively anchored at one end of through hole 120. Optionally, a force, labeled F, directed generally toward the cutting face 113 of cutting element 8 and generally perpendicular thereto may be generated on base member 16 by contact between structural element 71 and base member 16. Such a force F may bias the base member 16 into recess 134. Explaining further, structural element 71 may be sized to fit within recessed portion 132 of bit blade 110 and anchor element 145 may be threaded onto structural element 71. Thus, relative rotation of structural element 71 and anchor element 145 may force an end of structural element 71 into base member 16 and anchor element 145 against surface 136 of recessed portion 132 to generate force F. Structural element 71 may be mechanically coupled to anchor element 145 or directly to bit blade 310 as described above or as otherwise known in the art. It should be understood that recess 134 may be, in another embodiment, substantially cylindrical and sized so that a substantially cylindrical base member may be press-fit therein.

Figure 25:
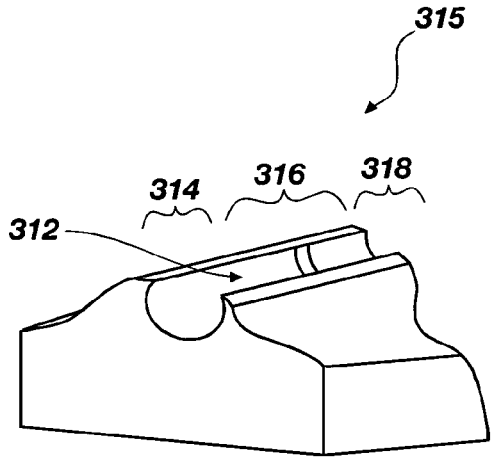
FIG. 25 shows a partial perspective view of a bit blade including a recess for accepting a cutting element assembly according to the present invention.

Although the embodiments of bit blade 110, 210, and 310 each include a support portion 116 or 119, respectively, which completely surrounds at least a portion of a periphery of the base member 16, the present invention is not so limited. Rather, it should be understood that support portion 116 or 119, particularly, recess 112 or recess 134 may not completely surround a periphery of a base member positioned therein. Thus, a recess 112 or recess 134 may surround a portion of a periphery of a base member positioned therein to mechanically couple or secure a base member to a bit blade. For example, FIG. 25 shows a partial perspective view of one embodiment of a bit blade 315 having a recess 312 formed therein sized and configured to accept a base element affixed to a cutting element (e.g., a PDC cutter). In addition, FIG. 25 shows a cutting pocket portion 314 of bit blade 315, a support portion 316 of bit blade 315, and an anchor portion 318 of bit blade 315. Cutting pocket portion 314 of bit blade 315 may be generally configured for surrounding a portion of a circumference of a substantially cylindrical cutting element positioned therein and may inhibit erosion of a substrate of such a cutting element (e.g., a PDC cutter). Support portion 316 of bit blade 315 may include a recess 312 configured for surrounding a portion of a periphery (e.g., a circumference) of a base member (e.g., a substantially cylindrical base member) positioned therein. Further, support portion 316 may be configured for accommodating a structural element for applying a force F to a base member positioned within recess 312, as discussed above. Anchor portion 318 of bit blade 315 may be structured for providing a structure for coupling a structural element thereto to apply a force to a base member positioned within recess 312.

Figure 26:
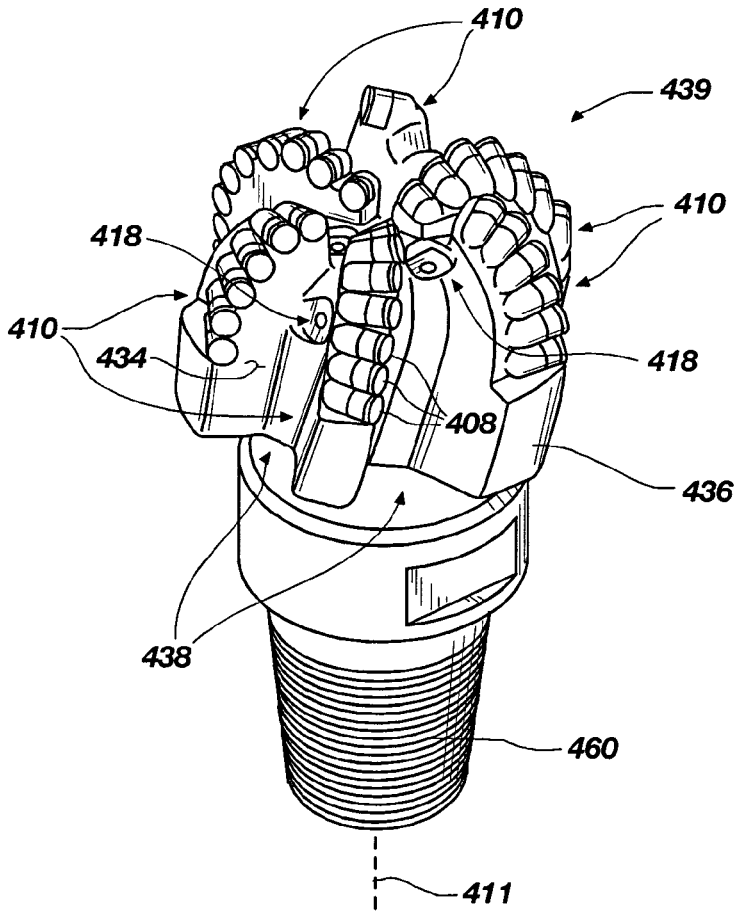
FIGS. 26 and 27 each show a perspective view and a top elevation view of a rotary drill bit including at least one cutting element assembly according to the present invention.
Figure 27:
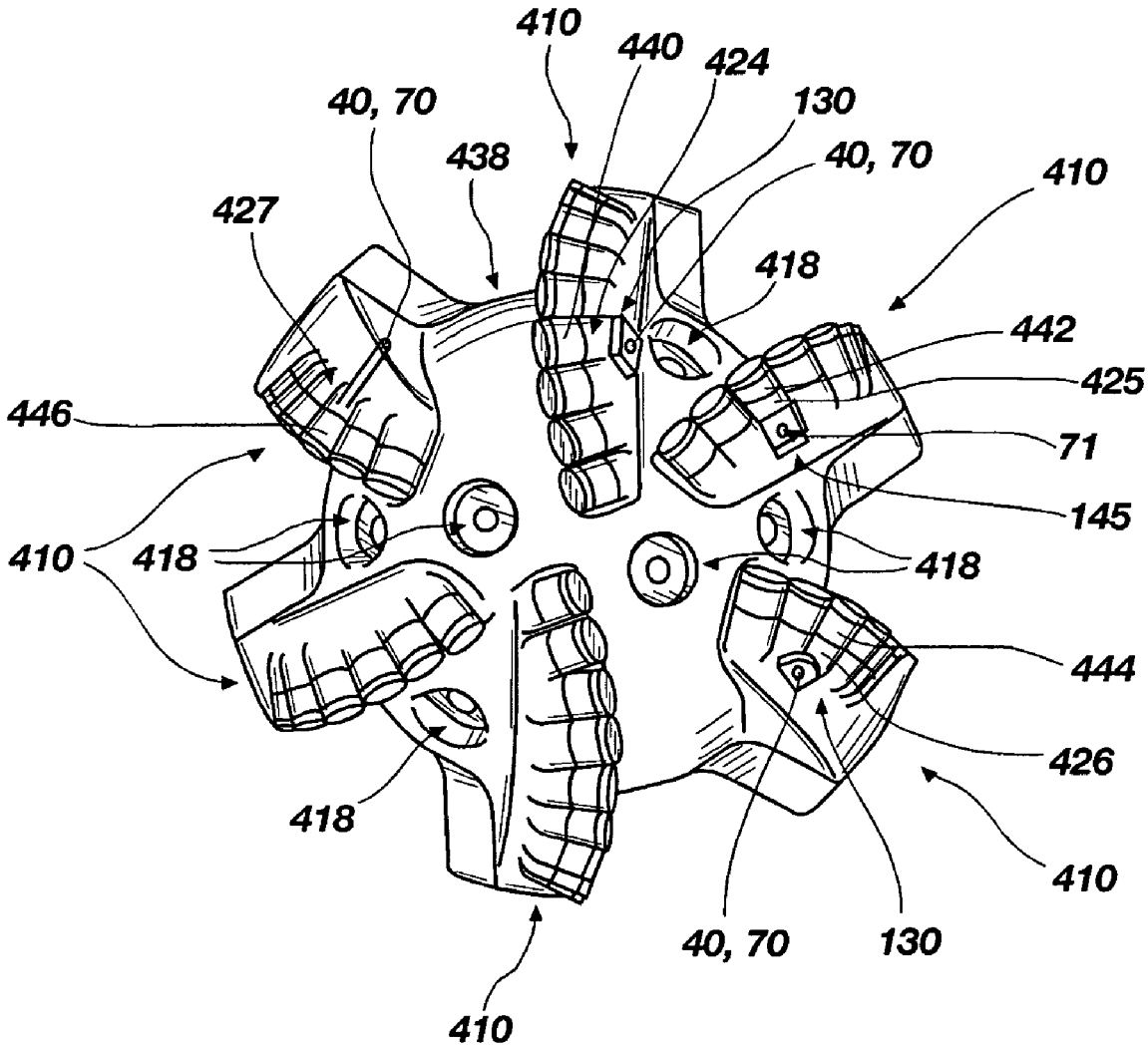

As may be appreciated from the foregoing discussion, the present invention further contemplates that a cutting element and base member affixed thereto may be coupled to a rotary drill bit. For example, FIGS. 26 and 27 show a perspective view and a top view, respectively, of an example of an exemplary rotary drill bit 401 of the present invention, wherein cutting elements 440, 442, 444, and 446 are secured the bit body 421 of rotary drill bit 401 by a base member 424, 425, 426, and 427, respectively, according to the present invention. Generally, rotary drill bit 401 includes a bit body 421 which defines a leading end structure for drilling into a subterranean formation. More particularly, rotary drill bit 410 may include radially and longitudinally extending blades 410 including leading faces 434. Further, circumferentially adjacent blades 410 define so-called junk slots 438 therebetween, as known in the art. As shown in FIG. 26, rotary drill bit 401 may also include, optionally, cutting elements 408 (e.g., generally cylindrical cutting elements such as PDC cutters) which are conventionally affixed to radially and longitudinally extending blades 410 (i.e., bit body 421). Additionally, rotary drill bit 401 includes nozzle cavities 438 for communicating drilling fluid from the interior of the rotary drill bit 401 to the cutting elements 408, face 439, and threaded pin connection 460 for connecting the rotary drill bit 401 to a drilling string, as known in the art.

Base members 424, 425, 426, and 427 may comprise any of the above-described embodiments of a base member (e.g., base member 16 as shown hereinabove) according to the present invention. It should be understood that although rotary drill bit 401 shows four base members 424, 425, 426, and 427, the present invention is not limited by such an example. Rather, a rotary drill bit according to the present invention may include, without limitation, one or more cutting element assemblies according to the present invention. Further, however, more specifically, as shown schematically in FIG. 27, each of base members 424, 425, 426, and 427 may be positioned within a recess formed in blades 410, respectively. Turning back to the exemplary rotary drill bit 401 shown in FIGS. 26 and 27, respective structural elements 40, 71, or 70 may be employed in combination with any of base members 424, 425, 426, and 427 according to any of the embodiments discussed above. Further, optionally anchor elements 130 or 145, may be appropriately employed for affixing a cutting element 408 to a bit blade 410. As discussed above, in one embodiment, any of base members 424, 425, 426, or 427 may be substantially cylindrical and may be positioned within a recess that surrounds more than half of a cross-sectional circumference of any of base members 424, 425, 426, or 427, respectively. Optionally, any of base members 424, 425, 426, or 427 may be press-fit within a recess formed within an associated bit blade 410. As shown in FIG. 27, a suitable structural element 40, 70, or 71 may be employed for securing a base member (e.g., a base member 424, 425, 426, or 427) to a bit blade 410. Any of cutting elements 440, 442, 444, or 446 may comprise a superabrasive layer affixed to a substrate, such as a PDC cutter.

It should be understood that FIGS. 26 and 27 merely depict one example of a rotary drill bit employing various embodiments of a cutting element assembly of the present invention, without limitation. More generally, a rotary drill bit may include at least one cutting element assembly (i.e., at least one cutting element affixed to a base member) according to the present invention, without limitation. Thus, as illustrated and described above, one or more cutting element assembly embodiment of the present invention may be employed for coupling one or more respective cutting elements to a rotary drill bit.

While certain embodiments and details have been included herein and in the attached invention disclosure for purposes of illustrating the invention, it will be apparent to those skilled in the art that various changes in the methods and apparatus disclosed herein may be made without departing form the scope of the invention, which is defined in the appended claims. The words "including" and "having," as used herein, including the claims, shall have the same meaning as the word "comprising."

What is claimed is:

1. A cutting element assembly for use on a fixed cutter rotary drill bit for forming a borehole in a subterranean formation, the cutting element assembly comprising:

a cutting element comprising a substrate having a layer of superabrasive material disposed on an end surface of the substrate, the substrate extending from the end surface to a back surface;

a base member affixed to the back surface of the substrate, the base member comprising an internal recess having a longitudinal axis, the recess configured to secure the base member to a fixed cutter rotary drill bit;

wherein the longitudinal axis of the recess is substantially parallel with a longitudinal axis of the cutting element.

2. The cutting element assembly of claim 1, further comprising a structural element coupled to the recess of the base member.

3. The cutting element assembly of claim 1, wherein the base member is substantially frustoconical.

4. The cutting element assembly of claim 3, wherein the longitudinal axis of the base member is substantially aligned with the longitudinal axis of the cutting element.

5. The cutting element assembly of claim 2, wherein the structural element extends from the base member in a direction that is substantially parallel to the longitudinal axis of the cutting element.

6. The cutting element assembly of claim 1, wherein the base member is brazed to the back surface of the substrate.

7. The cutting element assembly of claim 1, further comprising an inner member positioned within the recess of the base member.

8. The cutting element assembly of claim 7, wherein at least a portion of an exterior surface of the inner member substantially corresponds to a surface of the base member that at least partially defines the recess.

9. The cutting element assembly of claim 7, wherein the inner member includes a threaded aperture.

10. The cutting element assembly of claim 9, further comprising a structural element coupled to the threaded aperture of the inner member.

11. The cutting element assembly of claim 10, further comprising at least one locking element positioned between the structural element and the inner member, wherein the at least one locking element is structured to resist rotation of either of the structural element and the inner member relative to one another.

12. The cutting element assembly of claim 7, wherein the inner member is affixed to the base member.

13. The cutting element assembly of claim 10, wherein the structural element extends from the base member in a direction that is substantially parallel to the longitudinal axis of the cutting element.

14. The cutting element assembly of claim 1, wherein the recess of the base member is tapered and has a cross-sectional size that decreases with respect to an increasing distance from the back surface of the substrate.

15. The cutting element assembly of claim 14, wherein the recess of the base member is substantially frustoconical.

16. The cutting element assembly of claim 1, wherein at least a portion of an exterior of the base member is tapered.

17. The cutting element assembly of claim 16, wherein the portion of the exterior of the base member is substantially frustoconical.

18. The cutting element assembly of claim 7, wherein the recess of the base member is tapered and has a cross-sectional size that decreases with respect to an increasing distance from the back surface of the substrate.

19. The cutting element assembly of claim 18, wherein the inner member comprises a steel alloy and the base member comprises cemented tungsten carbide.

20. The cutting element assembly of claim 19, wherein:

at least a portion of the base member is tapered and has a cross-sectional size that decreases with respect to an increasing distance from the back surface of the substrate; and the substrate is substantially cylindrical.

21. The cutting element assembly of claim 20, wherein the superabrasive material comprises polycrystalline diamond and wherein the substrate comprises cemented tungsten carbide.

22. The cutting element assembly of claim 1, wherein the superabrasive material comprises polycrystalline diamond.

23. The cutting element assembly of claim 1, further comprising a deformable layer formed upon at least a portion of an exterior of the base member.

24. A fixed cutter rotary drill bit for drilling a subterranean formation, comprising:

a bit body comprising a leading end having generally radially extending blades structured to facilitate drilling of a subterranean formation;

a cutting element assembly coupled to the bit body;

wherein the cutting element assembly includes a cutting element comprising a substrate including a layer of superabrasive material disposed on an end surface of the substrate and a base member affixed to a back surface of the substrate, wherein the base member includes an internal recess having a longitudinal axis, the recess configured to secure the base member to the bit body;

wherein the longitudinal axis of the recess is substantially parallel with a longitudinal axis of the cutting element.

25. The rotary drill bit of claim 24, further comprising a structural element coupled to the recess of the base member.

26. the rotary drill bit of claim 25, wherein the structural element extends from the base member in a direction that is substantially parallel to the longitudinal axis of the cutting element.

27. The rotary drill bit of claim 25, wherein the structural element is coupled to the bit body by a threaded anchor element.

28. The rotary drill bit of claim 25, wherein the structural element is structured for generating a force on the base member in a direction substantially perpendicular to a cutting face of the cutting element.

29. The rotary drill bit of claim 24, wherein the base member is substantially frustoconical.

30. The rotary drill bit of claim 29, wherein the longitudinal axis of the base member is substantially aligned with the longitudinal axis of the cutting element.

31. The rotary drill bit of claim 24, wherein the base member is brazed to the back surface of the substrate.

32. The rotary drill bit of claim 24, further comprising an inner member positioned within the recess of the base member.

33. The rotary drill bit of claim 32, wherein at least a portion of an exterior surface of the inner member substantially corresponds to a surface of the base member that at least partially defining the recess.

34. The rotary drill bit of claim 32, wherein the inner member includes a threaded aperture.

35. The rotary drill bit of claim 34, further comprising a structural element coupled to the threaded aperture of the inner member.

36. The rotary drill bit of claim 35, wherein the structural element extends from the base member in a direction that is substantially parallel to the longitudinal axis of the cutting element.

37. The rotary drill bit of claim 35, further comprising a locking element positioned between the structural element and the inner member, wherein the locking element is structured to resist rotation of either of the structural element and the inner member relative to one another.

38. The rotary drill bit of claim 32, wherein the inner member is affixed to the base member.

39. The rotary drill bit of claim 38, wherein the inner member is brazed to the base member.

40. The rotary drill bit of claim 24, wherein the recess of the base member is tapered and has a cross-sectional size that decreases with respect to an increasing distance from the back surface of the substrate.

41. The rotary drill bit of claim 40, wherein the recess of the base member is substantially frustoconical.

42. The rotary drill bit of claim 24, wherein at least a portion of an exterior of the base member is tapered.

43. The rotary drill bit of claim 42, wherein the portion of the exterior of the base member is substantially frustoconical.

44. The rotary drill bit of claim 32, wherein the recess of the base member is tapered and has a cross-sectional size that decreases with respect to an increasing distance from the back surface of the substrate.

45. The rotary drill bit of claim 44, wherein the inner member comprises a steel alloy and the base member comprises cemented tungsten carbide.

46. The rotary drill bit of claim 44, wherein:

at least a portion of the base member is tapered and has a cross-sectional size that decreases with respect to an increasing distance from the back surface of the substrate; and the substrate is substantially cylindrical.

47. The rotary drill bit of claim 46, wherein the superabrasive material comprises polycrystalline diamond and wherein the substrate comprises cemented tungsten carbide.

48. The rotary drill bit of claim 24, wherein the superabrasive material comprises polycrystalline diamond.

49. The rotary drill bit of claim 24, further comprising at least one of a deformable layer or a deformable washer positioned between the base member and the bit body.

50. A method of securing a cutting element to a fixed cutter rotary drill bit for drilling a subterranean formation, the method comprising:

providing a cutting element assembly including a cutting element comprising a substrate including a layer of superabrasive material disposed on an end surface of the substrate and a base member affixed to a back surface of the substrate, wherein the base member includes an internal recess;

positioning the base member within a recess formed in a bit body of a fixed cutter rotary. drill bit;

securing the base member to the bit body by coupling a structural element to the internal recess of the base member and to the bit body;

applying a force to the base member in a direction substantially perpendicular to a cutting face of the cutting element to bias the base member into the recess formed in the bit body.

51. The method of claim 50, wherein a longitudinal axis of the internal recess is substantially parallel to a longitudinal axis of the cutting element.

52. The method of claim 50, wherein applying a force to the base member comprises applying the force away from a cutting face of the cutting element.

53. The method of claim 50, wherein positioning the base member within the recess formed in the bit body comprises positioning the base member within a recess formed in a bit blade.

54. The method of claim 50, wherein positioning the base member within a recess formed in the bit blade comprises press-fitting the base member within the recess formed in the bit blade.

55. The method of claim 50, wherein positioning the base member within the recess formed in the bit body comprises positioning the base member within a recess formed in a bit blade.

56. The method of claim 50, wherein a longitudinal axis of the structural element is substantially parallel to the longitudinal axis of the cutting element.

57. A cutting element assembly for use on a fixed cutter rotary drill bit for forming a borehole in a subterranean formation, the cutting element assembly comprising:

a cutting element comprising a substrate having a layer of superabrasive material disposed along an entire periphery of the substrate, the substrate extending from a front surface to a back surface;

a base member affixed to the back surface of the substrate, the base member comprising an internal recess having a longitudinal axis, the recess configured to secure the base member to a fixed cutter rotary drill bit;

wherein the longitudinal axis of the recess is substantially parallel with a longitudinal axis of the cutting element.

58. A cutting element assembly for use on a fixed cutter rotary drill bit for forming a borehole in a subterranean formation, the cutting element assembly comprising:

a cutting element comprising a substrate having a layer of superabrasive material disposed along substantially an entire periphery of the substrate, the substrate extending from a front surface to a back surface;

a base member affixed to the back surface of the substrate, the base member comprising an internal recess having a longitudinal axis, the recess configured to secure the base member to a rotary drill bit;

wherein the longitudinal axis of the recess is substantially parallel with a longitudinal axis of the cutting element.

59. A cutting element assembly for use on a fixed cutter rotary drill bit for forming a borehole in a subterranean formation, the cutting element assembly comprising:

a cutting element comprising a substrate having a layer of superabrasive material disposed along a cylindrical periphery of the substrate, the substrate extending from the end surface to a back surface;

a base member affixed to the back surface of the substrate, the base member comprising an internal recess having a longitudinal axis, the recess configured to secure the base member to a fixed cutter rotary drill bit;

wherein the longitudinal axis of the recess is substantially parallel with a longitudinal axis of the cutting element.

60. A fixed cutter rotary drill bit for drilling a subterranean formation, comprising:

a bit body comprising a leading end having generally radially extending blades structured to facilitate drilling of a subterranean formation;

a cutting element assembly coupled to the bit body;

wherein the cutting element assembly includes a cutting element comprising a substrate including a layer of superabrasive material disposed along a cylindrical periphery of the substrate and a base member affixed to a back surface of the substrate, wherein the base member includes an internal recess having a longitudinal axis, the recess configured to secure the base member to the bit body;

wherein the longitudinal axis of the recess is substantially parallel with a longitudinal axis of the cutting element.

* * * * *